US008539677B2

(12) United States Patent
Strauss

(10) Patent No.: US 8,539,677 B2
(45) Date of Patent: Sep. 24, 2013

(54) UTILITY KNIFE

(75) Inventor: Ralf Strauss, Huntersville, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 359 days.

(21) Appl. No.: 12/858,019

(22) Filed: Aug. 17, 2010

(65) Prior Publication Data

US 2012/0042522 A1 Feb. 23, 2012

(51) Int. Cl.
*B26B 21/00* (2006.01)

(52) U.S. Cl.
USPC ..... 30/162; 30/335

(58) Field of Classification Search
USPC ..... 30/162–164, 335–340, 342
See application file for complete search history.

(56) References Cited

U.S. PATENT DOCUMENTS

| | | | | |
|---|---|---|---|---|
| 4,575,940 | A | 3/1986 | Wenzel | |
| 4,586,256 | A | 5/1986 | Weimann | |
| 5,022,156 | A | 6/1991 | Kallens et al. | |
| 5,025,558 | A | 6/1991 | Gilbert | |
| D352,881 | S | 11/1994 | Schmidt | |
| 5,864,952 | A * | 2/1999 | Chung | 30/162 |
| D426,133 | S | 6/2000 | Degen et al. | |
| 6,163,963 | A * | 12/2000 | Huang | 30/162 |
| 6,192,589 | B1 | 2/2001 | Martone et al. | |
| 6,223,439 | B1 | 5/2001 | Wonderley | |
| 6,263,577 | B1 * | 7/2001 | Wonderley | 30/152 |
| D453,461 | S | 2/2002 | Chen | |
| 6,349,473 | B1 * | 2/2002 | Schmidt | 30/162 |
| D462,250 | S | 9/2002 | Ping | |
| 6,449,850 | B1 * | 9/2002 | Gilbert | 30/162 |
| 6,532,670 | B1 | 3/2003 | Berns | |
| 6,546,632 | B2 * | 4/2003 | Gilbert | 30/162 |
| 6,574,872 | B2 * | 6/2003 | Roberts et al. | 30/330 |
| 6,742,261 | B2 * | 6/2004 | Ho | 30/162 |
| 6,752,054 | B2 | 6/2004 | Knight | |
| 6,829,827 | B2 | 12/2004 | Tseng | |
| D508,839 | S | 8/2005 | Brown et al. | |
| D510,010 | S | 9/2005 | Brown et al. | |
| D511,288 | S | 11/2005 | Brown et al. | |
| D511,447 | S | 11/2005 | Brown et al. | |
| 6,971,178 | B2 * | 12/2005 | Rowlay | 30/162 |
| D520,327 | S | 5/2006 | Gist et al. | |
| 7,100,285 | B1 * | 9/2006 | Huang | 30/162 |

(Continued)

OTHER PUBLICATIONS

U.S. Appl. No. 12/858,013, filed Aug. 17, 2010.

(Continued)

*Primary Examiner* — Alvin Chin Shue
*Assistant Examiner* — Daniel Cahn
(74) *Attorney, Agent, or Firm* — Dennis J. Williamson; Moore & Van Allen PLLC

(57) ABSTRACT

A utility knife comprises a first housing portion carrying a strike plate and a second housing portion movable relative to the first housing portion between a closed position and an open position. The second housing portion carries a locking member. An overlapping locking mechanism locks the first housing portion to the second housing portion in a first direction when the first housing portion is moved relative to the second housing portion in a second direction. The locking member is movable between a first position in which it engages the strike plate to prevent the first housing from moving relative to the second housing in the first direction and a second position in which it does not engage the strike plate and allows the first housing to move relative to the second housing in the first direction.

18 Claims, 8 Drawing Sheets

(56) References Cited

U.S. PATENT DOCUMENTS

| | | | | |
|---|---|---|---|---|
| 7,131,204 | B2 * | 11/2006 | Brown et al. | 30/162 |
| 7,316,070 | B2 | 1/2008 | Green | |
| 7,389,587 | B2 * | 6/2008 | Di Bitonto et al. | 30/162 |
| 7,739,799 | B2 * | 6/2010 | Van Deursen | 30/142 |
| 7,814,664 | B2 | 10/2010 | LeBlanc et al. | |
| 8,069,569 | B2 * | 12/2011 | Brown et al. | 30/125 |
| 8,220,161 | B2 * | 7/2012 | Chang | 30/162 |
| 2002/0144407 | A1 * | 10/2002 | Gilbert | 30/162 |
| 2003/0084575 | A1 * | 5/2003 | Chen | 30/162 |
| 2003/0196331 | A1 * | 10/2003 | Ho | 30/162 |
| 2004/0045167 | A1 * | 3/2004 | Gringer et al. | 30/125 |
| 2005/0015996 | A1 * | 1/2005 | Chih | 30/162 |
| 2005/0172496 | A1 * | 8/2005 | Zeng | 30/151 |
| 2005/0188541 | A1 * | 9/2005 | Brown et al. | 30/162 |
| 2005/0193566 | A1 * | 9/2005 | Brown et al. | 30/162 |
| 2005/0235499 | A1 * | 10/2005 | Van Deursen et al. | 30/152 |
| 2006/0080842 | A1 * | 4/2006 | Schmidt | 30/162 |
| 2007/0050988 | A1 * | 3/2007 | Di Bitonto et al. | 30/162 |
| 2007/0068003 | A1 * | 3/2007 | Schmidt | 30/162 |
| 2007/0209209 | A1 * | 9/2007 | Davis et al. | 30/162 |
| 2007/0220758 | A1 * | 9/2007 | Ho | 30/162 |
| 2007/0256310 | A1 * | 11/2007 | Pool et al. | 30/339 |
| 2007/0294896 | A1 * | 12/2007 | Brown et al. | 30/162 |
| 2010/0037468 | A1 * | 2/2010 | Rowlay et al. | 30/162 |
| 2010/0126024 | A1 * | 5/2010 | Price | 30/162 |
| 2010/0132199 | A1 * | 6/2010 | Ruan | 30/162 |
| 2010/0212164 | A1 * | 8/2010 | Garavaglia et al. | 30/162 |
| 2010/0281696 | A1 * | 11/2010 | Hao et al. | 30/152 |
| 2011/0271531 | A1 * | 11/2011 | Huang | 30/162 |
| 2012/0216412 | A1 * | 8/2012 | Chung et al. | 30/143 |
| 2012/0272529 | A1 * | 11/2012 | Constantine et al. | 30/162 |
| 2012/0279071 | A1 * | 11/2012 | Garavaglia et al. | 30/162 |

OTHER PUBLICATIONS

U.S. Appl. No. 12/858,023, filed Aug. 17, 2010.

U.S. Patent and Trademark Office, U.S. Appl. No. 12/858,023, Office Action, Dec. 7, 2012.

* cited by examiner

UTILITY KNIFE

The invention relates generally to utility knives and more particularly to a utility knife with an improved locking assembly and blade carrier.

BACKGROUND OF THE INVENTION

Utility knives typically comprise a knife housing that is provided with an aperture that receives a blade such that the blade extends from the housing. A user can grasp the housing and use the blade for cutting or slicing. When the blade becomes worn, dull or breaks the housing may be opened to allow replacement of the blade.

SUMMARY OF THE INVENTION

A utility knife comprises a housing comprised of a first housing portion and a second housing portion movable relative to the first housing portion between a closed position and an open position. The first portion carries a strike plate and the second housing portion carries a locking member. An overlapping locking mechanism locks the first housing portion relative to the second housing portion to prevent relative movement in a first direction. The overlapping locking mechanism can be unlocked by moving the first housing portion relative to the second housing portion in a second direction. The locking member is movable between a first position in which it engages the strike plate to prevent the first housing from moving relative to the second housing in the second direction and a second position in which it does not engage the strike plate and allows the first housing to move relative to the second housing in the second direction.

The first housing portion may comprise a first perimeter edge that abuts a second coextensive perimeter edge on the second housing portion defining a seam where the overlapping locking mechanism extends across the seam. The first housing portion may carry a pin that extends through a slotted aperture formed in the second housing portion such that the first housing portion and second housing portion are rotatable relative to one another about the pin. The overlapping locking mechanism may be positioned remote from the pin. The locking member may be biased to the locked position and may comprise a resilient member such as a leaf spring. The locking member may have a fixed end and a movable free end such that when the locking member is in the first position the free end is positioned directly behind the strike plate. A button may be moveable between a locked position and an unlocked position where the button terminates in a distal end that is disposed opposite the free end of the locking member. The locking member may bias the button to the locked position and the button may be depressed to move the locking member to the second position. The locking member may bias the first housing portion away from the second housing portion.

A safety mechanism may prevent the second housing portion from moving in the second direction even when the locking member is in the unlocked position. The safety mechanism may include a blade carrier that holds a blade in an extended and a retracted position relative to the housing. The blade carrier may comprise a latch engageable with a first stop to fix the position of the first housing portion and the second housing portion relative to the latch. The latch may engage a second stop to fix the position of the first housing portion relative to the latch and allow movement of the second housing portion relative to the latch. The latch may comprise a resilient member comprising a tab engageable with the first stop and the second stop. An actuator button may extend through a slot formed in the housing and be connected to the carrier. The second housing portion may comprise a first plurality of recesses that are dimensioned such that the first tab can be located in any one of the first plurality of recesses and the first housing portion may comprise a second plurality of recesses that are dimensioned such that a second tab can be located in any one of the second plurality of recesses. At least one of the second plurality of recesses has a width that is greater than the width of the second tab to define a gap that allows the first housing portion to move rearward relative to the second housing portion. The gap is sized such that the housing portions are able to move relative to one another a distance sufficient to disengage the overlapping locking mechanism.

The utility knife may comprise a blade holder comprising a wireform having a first end secured to one of the first or second housing portions and a second free end where the wireform is bent such that the second free end clamps a spare blade against the fists or second housing portions.

DETAILED DESCRIPTION OF EMBODIMENTS OF THE INVENTION

Figure 1:
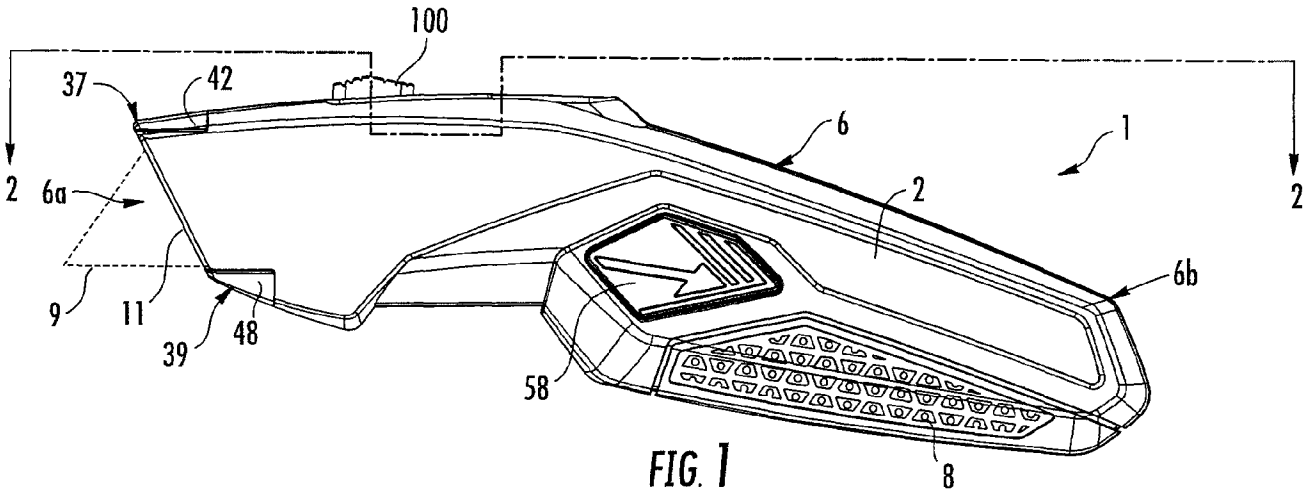
FIG. 1 is a front view of an embodiment of the utility knife of the invention in the closed position.

The utility knife is shown generally at 1 in the figures and comprises a first housing portion 2 and a second housing portion 4. The housing portions are releasably secured to one another to form the complete knife housing 6. The knife housing 6 has a generally elongated profile that may be comfortably grasped by a user's hand with the front end or nose **6*a* of the knife extending from the user's hand. Toward the rear end or butt 6*b* of the housing 6 a hand grip 8** is formed that may be gripped during use of the knife.

The first housing portion 2 comprises a perimeter edge 10 that abuts a substantially coextensive perimeter edge 12 on the second housing portion 4 in the assembled housing 6 to define a generally open interior. A slot 11 is provided in the nose **6*a* between the first housing portion 2 and the second housing portion 4 through which a blade 9 extends during use of the knife. Near the rear end 6*b* the first housing portion 2, raised projections 14 are formed that extend outwardly from the perimeter edge 10. Raised projections 14 extend inside of the perimeter edge 12 of the second housing portion 4 to align the housing portions 2 and 4 in the assembled housing 6**.

Figure 8:
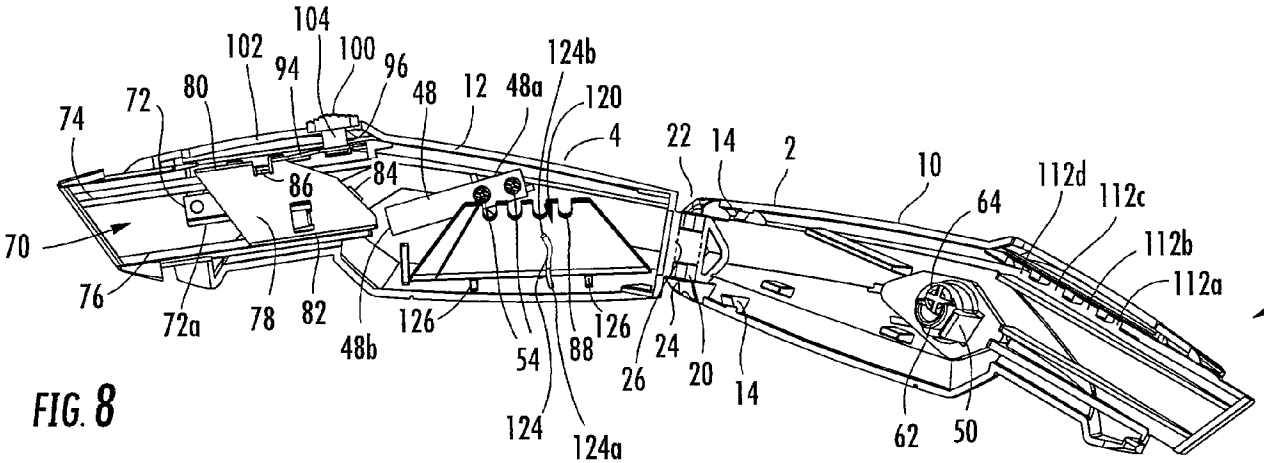
FIG. 8 is a front view of the utility knife of FIG. 1 in a completely open position.
Figure 9:
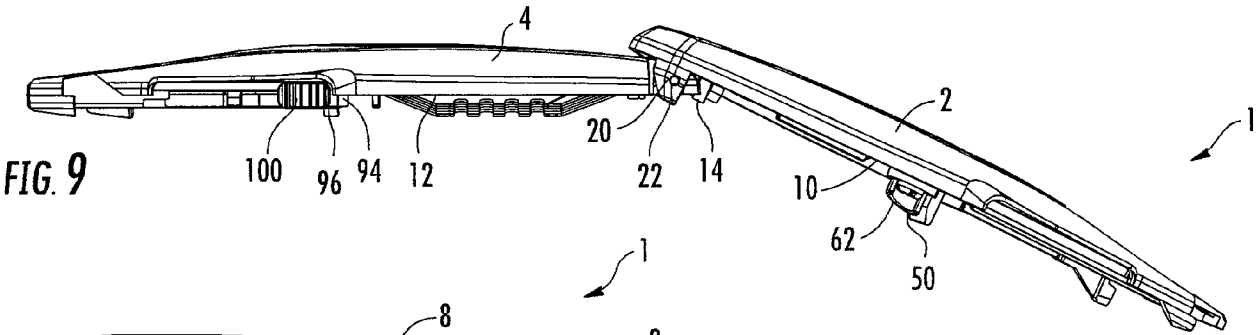
FIG. 9 is a top view of the utility knife as shown in FIG. 8.
Figure 7:
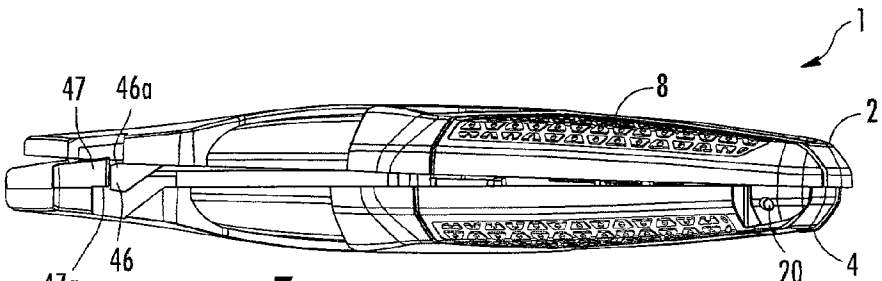
FIG. 7 is a bottom view of the utility knife as shown in FIG. 3.

At the rear end 6*b* of housing 6 housing portion 2 carries a pin 20 supported between spaced supports 22 and 24 in a generally fixed position. Pin 20 extends through a slotted aperture 26 formed in housing portion 4 such that the housing portions 2 and 4 can rotate relative to one another about pin 20 between the closed position of FIG. 1 and the open position of FIGS. 8 and 9. Slotted aperture 26 is wider than the pin 20 such that the pin 20 can also move in aperture 26 toward and away from the nose 6*a*. This axial movement allows housing portion 2 to move a limited distance along the length of housing portion 4 as will hereinafter be described. The term "axial" as used herein means generally along the long axis of the knife from nose 6*a* to rear end 6*b* as represented by arrow A in FIG. 2.

Figure 2:
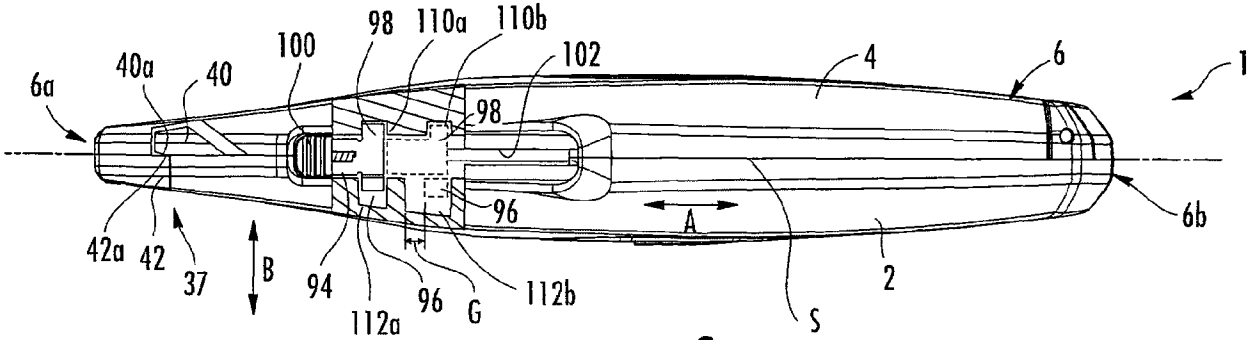
FIG. 2 is a section view taken along line 2-2 of FIG. 1.
Figure 3:
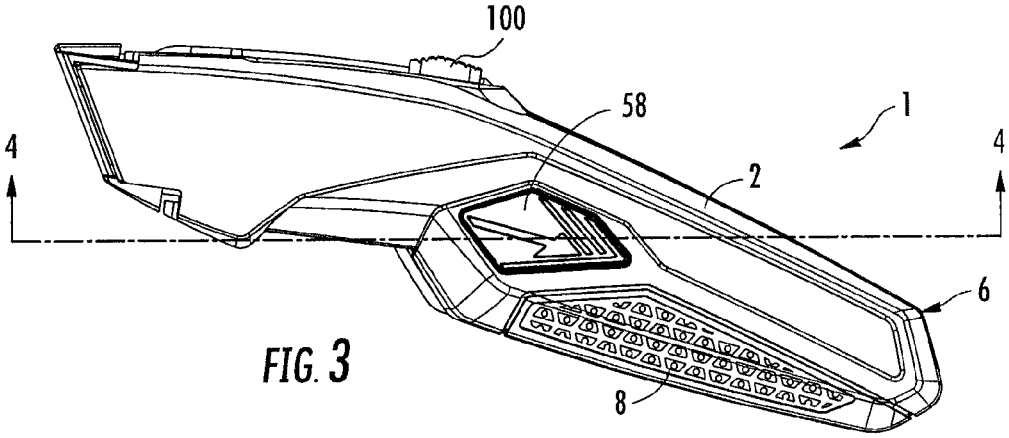
FIG. 3 is a front view of the utility knife of FIG. 1 in an open position.

Overlapping locking mechanisms 37 and 39 are formed at the nose 6*a* of the knife to lock the housing portions 2 and 4 together. The overlapping locking mechanisms engage one another to prevent the housing portions 2 and 4 from separating from one another at the nose 6*a* due to the forces exerted on the housing 6 by the blade 9 during use of the knife. Referring to FIG. 2, overlapping locking mechanism 37 is located at the top end of the nose 6*a* and includes an engagement element 40 on housing portion 2. Engagement element 40 extends across the seam S, where seam S is defined by the edges 10 and 12 when they abut in the closed housing 6. Engagement element 40 defines a bearing surface 40*a* that faces seam S. Housing portion 4 includes a mating engagement element 42 that includes a bearing surface 42*a* that faces opposite to bearing surface 40*a*.

To assemble the housing 6 the housing portion 2 is placed against housing portion 4 in a slightly offset position with the housing portion 2 offset toward the rear of housing portion 4. Housing portion 2 is slid in the axial direction toward the nose of housing portion 4 until bearing surface 40*a* of engagement element 40 is disposed behind bearing surface 42*a* of engagement element 42. The engagement of element 40 and element 42 prevents housing 2 from moving away from housing portion 4 along a transverse direction, represented by arrow B, that is disposed generally perpendicular to the axial direction. Because of the mechanical interlocking of the engagement elements 40 and 42 the nose 6*a* cannot be pried apart.

Figure 4:
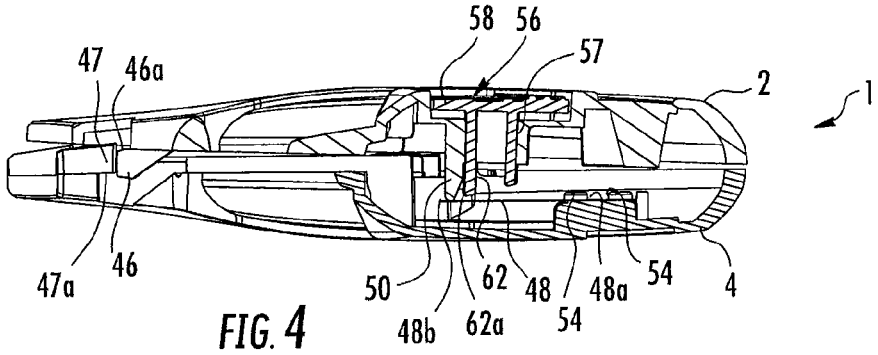
FIG. 4 is a section view taken along line 4-4 of FIG. 3.

A similar overlapping locking mechanism 39 is formed on the bottom end of nose 6*a*. Referring to FIG. 4, interlocking mechanism 39 is shown in the open position. Housing portion 2 includes an engagement element 46 that extends across the seam S when the housing portions 2 and 4 are in the closed position. Engagement element 46 defines a bearing surface 46*a* that faces the housing portion 2. Housing portion 4 includes a mating engagement element 47 that includes a bearing surface 47*a* that faces opposite to bearing surface 46*a*. To assemble the housing 6 the housing portion 2 is pushed against housing portion 4 in the slightly offset position. Housing portion 2 is slid forward in the axial direction relative to housing portion 4 until engagement element 46 is disposed behind engagement element 47. The engagement of these elements prevents the nose of the knife from being pried open by forces exerted by the blade on the housing during use of the knife.

To lock the housing portion 2 to the housing portion 4 a locking member 48 is provided on one of the housing portions that engages a fixed strike plate 50 on the other housing portion. In the illustrated embodiment the locking member 48 is formed on housing portion 4 and strike plate 50 is formed on the housing portion 2 at a generally central location. The strike plate 50 is fixed to the housing portion 2 and extends therefrom toward housing portion 4. The locking member 48 is mounted to the other housing portion 4 opposite to the strike plate 50.

Figure 5:
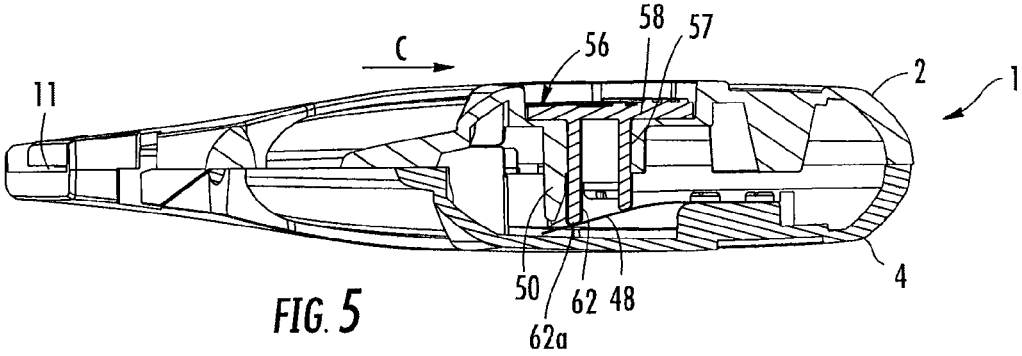
FIG. 5 is a section view similar to that of FIG. 4 with the housing portions in contact with one another.
Figure 6:
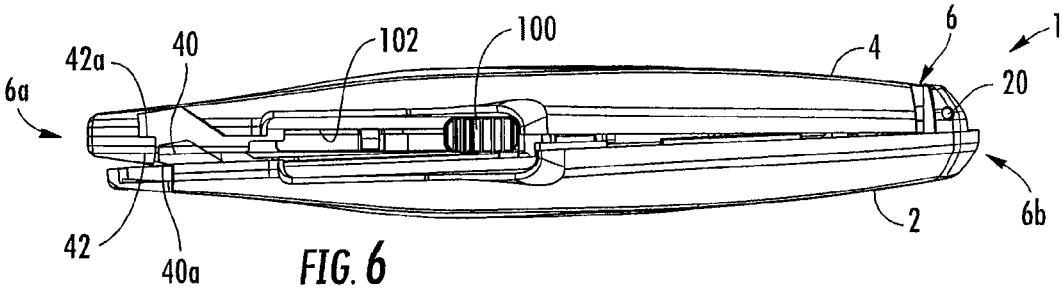
FIG. 6 is a top view of the utility knife as shown in FIG. 3.

The locking member 48 comprises a member movable between a first locked position and a second unlocked position. The locking member is biased to the locked position. In the illustrated embodiment the locking member 48 comprises a resilient member in the form of a leaf spring. A first end 48*a* of the spring is fixed to housing 4 such as by fasteners 54 and the opposite free end 48*b* extends from the housing in a cantilevered fashion such that it may move toward and away from the housing portion 4 between the unlocked and locked positions respectively. The leaf spring is made of a resilient material such as steel such that it may be deformed to occupy the unlocked position and resiliently return to its original shape to occupy the locked position. FIG. 4 shows the locking member 48 in the undeformed position. FIG. 5 shows the locking member 48 in the deformed, unlocked position where it is moved from the locked position of FIG. 4 toward housing portion 4. Locking member 48 may alternatively be a rigid member movable between the locked and unlocked positions and biased to the locked position by a separate spring.

Figure 10:
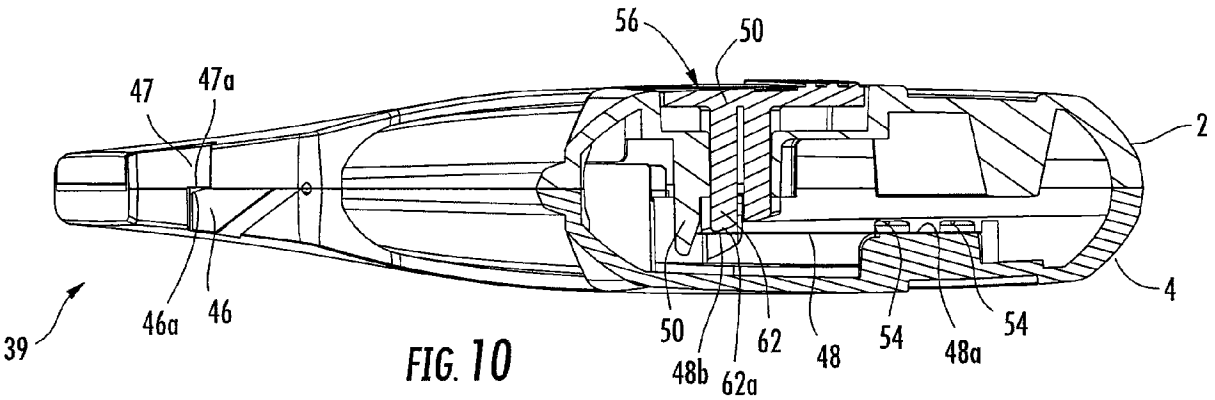
FIG. 10 is a section view similar to that of FIG. 5 in the closed position.

When locking member 48 is in the locked position and housing 6 is fully closed the distal end 48*b* of locking member 48 is positioned directly behind (toward rear end 6*b*) strike plate 50, FIG. 10. When locking member 48 is in this position and housing portions 2 and 4 are closed against one another, locking member 48 prevents housing portion 2 from sliding rearward relative to the housing portion 4 along axial direction A. The distal end 48*b* of locking member 48 abuts strike plate 50 and blocks axial movement of the housing portion 2 rearward relative to housing portion 4. If the housing portions 2 and 4 are prevented from moving axially relative to one another, the overlapping locking mechanisms 37 and 39 remain engaged such that the housing portions 2 and 4 cannot be separated at nose 6*a* and cannot be opened. The rear end 6*b* of the housing 6 also cannot be separated due to the engagement of pin 20 with slot 26. As a result, the housing portions 2 and 4 remain fixed to one another in the closed position.

Referring to FIGS. 1, 4, 5 and 8, a push button 56 extends through a hole 57 formed in the wall of the housing portion 2. Push button 56 has a head 58 that is located on the outside of the housing portion 2 where it may be pressed by a user to move the push button relative to the housing 6 towards and away from housing portion 4. Push button 56 moves between an extended locked position to a depressed unlocked position. The head 58 is larger than the hole 57 and may include raised areas or other topography to facilitate the user's grip on the head. The shaft 62 of push button 56 extends through hole 57 and terminates in a distal end 62*a* that is disposed opposite the free end 48*b* of locking member 48. A fastener 64 or other device engages the shaft 62 to retain the push button 56 in the housing portion 2.

The shaft 62 has a length such that when the locking member 48 is in the locked position, and the housing portions 2 and 4 are closed, the free end 48*b* of locking member 48 contacts the end 62*a* of shaft 62 and biases the push button 56 to the extended locked position, FIG. 10. When the push button 56 is depressed by the user, the shaft 62 is moved toward housing portion 4 against the bias of locking member 48 until the distal end 48*b* of the locking member 48 is not in blocking engagement with the strike plate 50. The shaft 62 pushes against the locking member 48 until the end 48*b* of the locking member 48 moves beyond the end of the strike plate 50. Because the locking member 48 is no longer in blocking contact with the strike plate 50 the housing portion 2 can slide in the axial direction relative to housing portion 4 toward the rear end 6*b* of the knife.

Moving housing portion 2 rearward relative to housing portion 4 disengages the overlapping locking mechanisms 37 and 39. Once the overlapping locking mechanisms 37 and 39 are no longer engaged the nose end of housing portion 2 can move transversely away from the nose end of housing portion 4 allowing the housing portions to separate from one another as shown in FIGS. 3, 5, 6 and 7. The housing portions 2 and 4 can be rotated about pin 20 to the fully open position shown in FIGS. 8 and 9.

As the housing portion 2 is slid rearward relative to housing portion 4 to disengage locking mechanisms 37 and 39, the locking member 48 is biased against the distal end of the strike plate 50. Because locking member 48 is biased into contact with strike plate 50, when the overlapping locking mechanisms 37 and 39 are disengaged, the locking member 48 biases the housing portion 2 away from housing portion 4 such that when the user releases housing portion 2, the housing portions are separated slightly by locking member 48 as shown in FIG. 4. The separation of the housing portions 2 and 4 allows the user to easily grasp and separate the housing portions to the fully open position of FIGS. 7 and 8.

Figure 11:
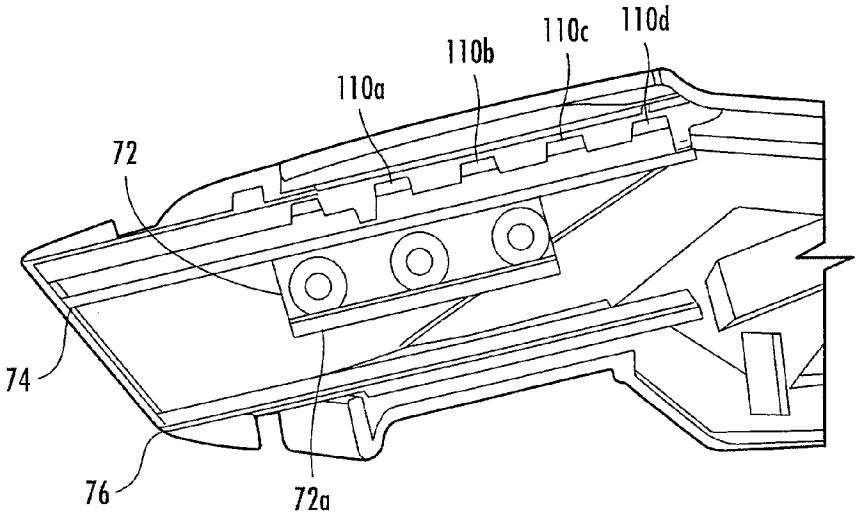
FIG. 11 is a detailed front view of a housing portion.
Figure 13:
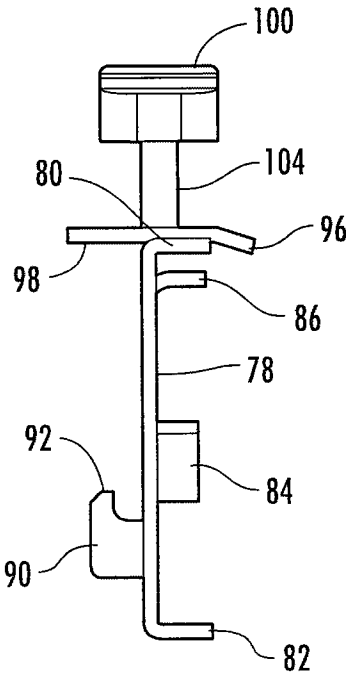
FIGS. 12 and 13 are detailed views of an embodiment of the blade carrier.
Figure 12:
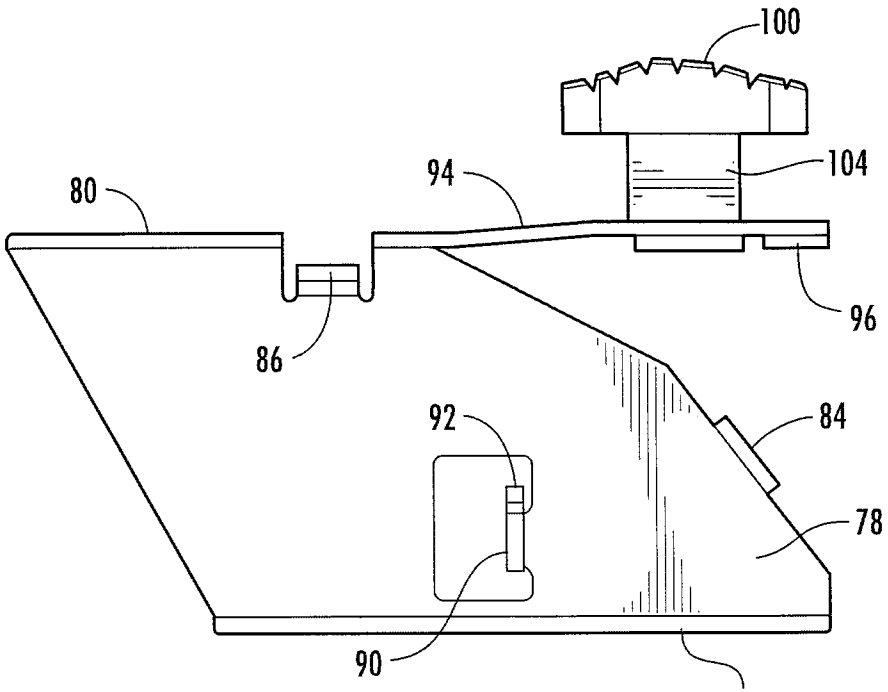

To prevent the housing 6 from inadvertently opening, the blade carrier 70 includes a safety feature that requires the user to properly position the blade carrier before the housing 6 can be opened. Referring to FIGS. 11, 12 and 13, the blade carrier 70 comprises a fixed rail 72 mounted to one of the housing portions, shown mounted to housing portion 4. The rail 72 has a downwardly extending edge 72*a* that is spaced from the housing wall and that extends along the direction of travel of the blade between the blade's extended and retracted positions. A first support surface 74 and a second support surface 76 extend along the direction of travel of the blade to support the blade carrier as it moves along the rail 72.

The blade carrier 70 comprises a relatively flat support plate 78 that rides on rail 72 and support surfaces 74, 76. The plate 78 is dimensioned and shaped to hold a blade between the outwardly extending flanges 80 and 82. A stop 84 is formed along the back edge of the plate 78 against which the back edge of the blade is positioned such that the blade is properly positioned and seated on the plate 78. A positioning member 86 extends from the plate 78 along the top edge thereof. Positioning member 86 engages one of a plurality of notches 88 formed in the top edge of the utility blade to retain the blade on carrier 70 and to properly position the blade 9 on the carrier 70 in one of a plurality of positions.

A retention clip 90 extends from the back of the plate 78. Clip 90 is positioned just below the edge 72*a* of rail 72 and is dimensioned such that it extends beyond edge 72*a*. The end of clip 90 is formed with a retaining member such as an upwardly extending finger 92 that is disposed behind the rail 72 such that the edge 72*a* of rail 72 sits in the groove 94. The clip 90 secures the carrier 70 to the rail 72 while allowing the carrier 70 to reciprocate along the length of rail 72. When the housing is in the open position, the carrier 70 may be removed by sliding the carrier 70 toward the front of the knife such that the clip 90 is disengaged from the rail 72. The carrier 70 may be removed for cleaning or maintaining the tool.

The carrier 70 also includes a latch 94 that locks the carrier in a fully retracted position, a fully extended position or one of a plurality of partially extended positions and also acts as a safety to prevent the inadvertent opening of the housing 6. The latch 94 extends from the top of the plate 78 and comprises a resilient member that extends toward the rear of the knife. The latch 94 has a T-shape where the tabs 96 and 98 extend toward the first housing portion 2 and the second housing portion 4, respectively. An actuator button 100 extends through a slot 102 formed in the housing 6 such that when the user moves the actuator button 100 in slot 102 the carrier 70 is reciprocated along rail 72. The button 100 is connected to the latch 94 by neck 104 that is long enough to allow the button 100 to be depressed such that the latch 94 can be deformed from the locking position shown in the figures to a release position as will hereinafter be described.

A series of stops are provided in the housing portion to fix the position of the carrier 70 in housing 6. Housing portion 4 includes a plurality of downwardly recesses 110*a*, 110*b*, 110*c* and 110*d* that extend along the length of the housing portion and are located along side of the latch 94. The recesses 110*a*, 110*b*, 110*c* and 110*d* are dimensioned such that the tab 98 can be located in any one of the recesses. The walls of the recesses act as stops to limit motion of carrier 70 relative to housing portion 4. Once the tab 98 is located in a recess the engagement of the tab 98 with the walls of the recess prevents the carrier 70 from moving along rail 72. By depressing button 100 and deforming latch 94 downward the tab 98 is removed from locking engagement with the recess.

Housing portion 2 includes a plurality of recesses 112*a*, 112*b*, 112*c* and 112*d* that extend along the length of the housing portion 2 and are located along side of the latch 94 and are positioned opposite to recesses 110*a*, 110*b*, 110*c* and 110*d*, respectively. The recesses 112*a*, 112*b*, 112*c* and 112*d* are dimensioned such that the tab 96 can be located in any one of the recesses. The recess 112*a* disposed closest to the nose of the knife is dimensioned like the recesses formed on housing portion 2 where the walls of the recesses act as stops such that engagement of the tab 96 with the walls of the recess 112*a* prevents relative movement between the carrier 70 and housing portion 2. The remaining recesses 112*b*, 112*c* and 112*d* have a width that is greater than the width of the tab 96. As shown in FIG. 2 recess 112*b* is wider than recess 112*a* or any of recesses 110*a*, 110*b*, 110*c* and 110*d*. Recesses 112*c* and 112*d* are sized and configured in the same manner as recess 112*b*. When tab 98 is located in one of recess 110*b*, 110*c* or 110*d* tab 96 is located in the corresponding recess 112*b*, 112*c* or 112*d* (shown in dashed line position in FIG. 2). Because recess 112*b*, 112*c* or 112*d* is wider than tab 96, tab 96 sits at the back of the recess with a gap G between the tab 96 and the front of the recess. The length of the gap G is slightly longer than the axial distance the housing portion 2 must move relative to housing portion 4 to disengage the overlapping locking mechanisms 37 and 39.

To move the carrier 70 and adjust its position in the housing 6, the user pushes down on button 100 to depress the latch 94 and force tab 96 out of recess 110*a*, 110*b*, 110*c* or 110*d* and tab 98 out of recess 112*a*, 112*b*, 112*c* or 112*d*. Once the tabs are removed from the recesses, and while the button 100 is depressed, the user can push on the button 100 to adjust the position of the carrier 70 in the housing 6 and the length of blade extending from the housing 6. The carrier 70 can move the tabs 96, 98 from forward most recesses 110*a* and 112*a* where the blade is fully extended to rearward most recesses 110*d* and 112*d* where the blade is fully retracted. At least one pair of intermediate recesses is provided 110*b*, 112*b* and 110*c*, 112*c* where the blade is extended but is in less than the fully extended position.

When the carrier 70 is in the fully extended position tab 98 is closely received in recess 110*a* and tab 96 is closely received in recess 112*a*. Because tab 96 is closely received in recess 112*a* carrier 70 is prevented from moving relative to the housing portion 2. Likewise, because tab 98 is closely received in recess 110*a* carrier 70 is also prevented from moving relative to the housing portion 4. Because carrier 70 is fixed relative to both housing portion 4 and housing portion 2, housing portion 2 is fixed relative to housing portion 4. Thus, when the carrier 70 is in the fully extended position, the housing portion 2 cannot move axially relative to housing portion 4. As a result, the overlapping locking mechanisms 37 and 39 cannot be disengaged and the housing portions 2 and 4 cannot be separated from one another. Thus, when the blade is in the fully extended position, the housing 6 cannot be inadvertently opened even if button 56 is depressed.

When the carrier 70 is in any position except the fully extended position the housing 6 can be opened. For purposes of explanation assumed that the carrier 70 is moved to the first retracted position where tab 98 engages recess 110*b* and tab 96 engages recess 112*b*. In this position, the position of the blade carrier 70 is fixed relative to housing portion 4 because tab 98 is closely received in recess 110*b* such that movement of the carrier 70 relative to the housing 6 is prevented. However, as previously explained, recess 112*b* is wider than the tab 96. As a result, the gap G, provided between tab 96 and the front of recess 112*b*, allows the housing portion 2 to slide rearward relative to housing portion 4 in the axial direction A far enough to disengage the overlapping locking mechanisms 37 and 39. While the gap G allows the housing portion 2 to slide rearward relative to housing portion 4, the housing portions cannot move relative to one another unless the push button 56 is depressed and the locking member 48 is disengaged from the strike plate 50. This embodiment provides the safety when the blade is in the fully extended position and allows the device to be opened when the blade is in any other position. The recesses may be configured such that the safety action is provided in other than or in addition to the fully extended position if desired.

Figure 16:
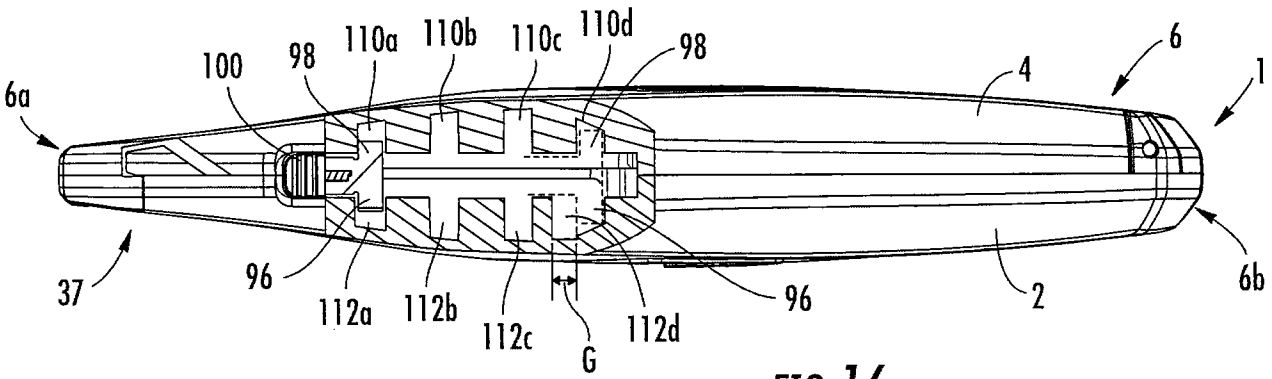
FIG. 16 is a section view similar to that of FIG. 2 showing an alternate embodiment of the invention.

An alternate embodiment of the knife is shown in FIG. 16 where like reference numerals are used to identify like components previously described with respect to FIGS. 1 through 10. The knife shown in FIG. 16 is the same as that previously described except that the housing 6 may only be opened if the blade carrier is in the fully retracted position. Housing portion 2 includes a plurality of recesses 112*a*, 112*b*, 112*c* and 112*d* that extend along the length of the housing portion 2 and are located along side of the latch 94 and are positioned opposite to recesses 110*a*, 110*b*, 110*c* and 110*d* formed in housing portion 4, respectively. The recesses 110*a*, 110*b*, 110*c* and 110*d* are dimensioned such that the tab 98 is closely received in any one of the recesses. The recesses 112*a*, 112*b* and 112*c* are also dimensioned like the recesses formed on housing portion 4 where the tab 96 is closely received by the walls of the recesses such that engagement of the tab 96 with the walls of the recesses 112*a*, 112*b* and 112*c* prevents relative movement between the housing portion 2 and carrier 70. The last recess 112*d* (the fully retracted position) has a width that is greater than the width of the tab 96. When tab 98 is located in 110*d*, tab 96 is located in the corresponding recess 112*d* as shown in dashed line. Because recess 112*d* is wider than tab 96, tab 96 sits at the back of the recess with a gap G between the tab 96 and the front of the recess such that the housing portion 2 can be slid rearward relative to housing portion 4, as previously described as previously described with reference to FIG. 2. When the carrier 70 is in any position except the fully retracted position, tab 96 is closely received in recesses 112*a*, 112*b* and 112*c* and the housing portion 2 cannot move axially relative to housing portion 4 such that the overlapping locking mechanisms 37 and 39 cannot be disengaged and the housing portions 2 and 4 cannot be separated from one another. Thus, when the carrier 70 is in any position except the fully retracted position, the housing 6 cannot be opened even if button 56 is depressed.

A blade holder 120 is also provided in the housing. The blade holder 120 comprises a wireform clamp 124 having one end 124*a* secured to housing portion 4 such as by a screw and a second free end 124*b*. The wireform is bent such that the free end 124*b* acts as a spring clamp to hold the blades. The wireform is slightly deformed when a blade or blades are located behind the wireform such that a clamping force is created on the blades to hold the blades in position. A platform may be provided against which that blades may be pressed by the wireform clamp. In the present embodiment the platform comprises a pair of supports 126 spaced such that the blades span the supports. Each support has a first end and a second end where the second end is disposed further away from the housing portion than the first end such that the blades are supported at an angle in the housing with the top ends of the blade projecting away from the housing. By angling the support surfaces 126 relative to the housing portion a space is provided between the top of the blades and the housing that allows the user's fingers to get behind the blades. The blades may be removed by grasping the top edge of the blades and slightly deforming the wireform 124 to release the blades.

Operation of the utility knife of the invention will be described with reference to the figures. Assume that the knife is in the assembled "use" configuration with the first housing portion 2 and the second housing portion 4 coupled together as shown in FIGS. 1 and 2. In this position edges 10 and 12 abut one another at seam S and the overlapping locking mechanisms 37 and 39 are engaged to prevent the housings 2 and 4 from separating. The locking member 48 is biased to the locked position where the locking member 48 is in blocking engagement with the strike plate 50 such that the housing portion 2 cannot move axially relative to housing portion 4 in the direction A. The locking member 48 is also biased into engagement with the distal end 62*a* of post 62 such that the locking member 48 biases push button 56 to the extended position.

The actuator button 100 can be depressed by a user to disengage the tabs 96 and 98 from the recesses and the blade carrier 70 moved along rail 72 to extend or retract the blade from the housing 6. When the push button is depressed the tab 96 is forced out of recess 112*a*, 112*b*, 112*c* or 112*d* and tab 98 is forced out of recess 110*a*, 110*b*, 110*c* or 110*d*. The button 100 can then be pushed forward or backward in the slot 102 to retract or extend the blade. When the button 100 is released the latch 94 resiliently returns to its undeflected position where tab 96 is enters one of recesses 112*a*, 112*b*, 112*c* or 112*d* and tab 98 is engaged with one of recesses 110*a*, 110*b*, 110*c* or 110*d*.

Figure 14:
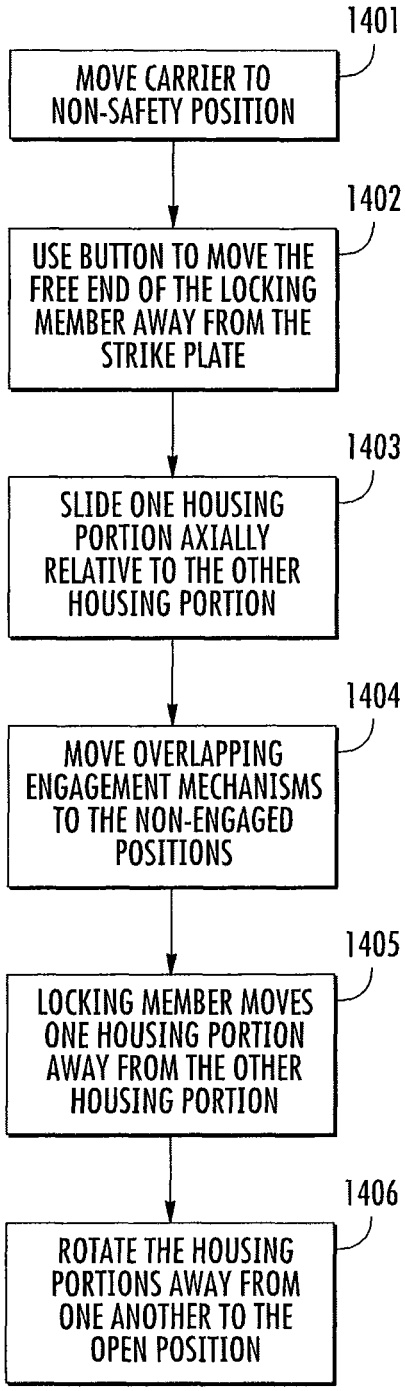
FIGS. 14 and 15 are block diagrams illustrating methods of operating the knife.

Referring to FIG. 14, to open the housing 6, the carrier 70 is moved to a non-safety position (block 1401). In the illustrated embodiment the carrier 70 may be moved to any position except for the fully extended position. The push button 56 is depressed forcing the end of post 62 against locking member 48 to move the free end 48*b* of locking member 48 away from and out of blocking engagement with the strike plate 50 (block 1402). While holding the button 56 in the depressed position, the user slides housing portion 2 rear ward relative to housing portion 4 (block 1403). The housing portion 2 is slid in the axial direction of arrow A toward the rear of the housing 6 as shown in FIG. 4. As the housing portion 2 is slid rearward, pivot pin 20 moves in slot 22 and the strike plate 50 rides over the locking member 48. Simultaneously, the overlapping engagement mechanisms 37 and 39 are moved from the engaging positions shown in FIGS. 1 and 2 to the non-engaged positions shown in FIG. 4 (block 1404). When the user releases the housing portion 2, the locking member 48 returns to its undeformed state forcing the housing portion 2 away from the housing portion 4 to the position shown in FIGS. 3, 5, 6 and 7 (block 1405). The housing portions 2 and 4 can be completely separated from one another by rotating the housing portions 2 and 4 away from one another to the position of FIGS. 8 and 9 (block 1406). The user can access the replacement blades to remove, replace and/or reposition the blade.

Figure 15:
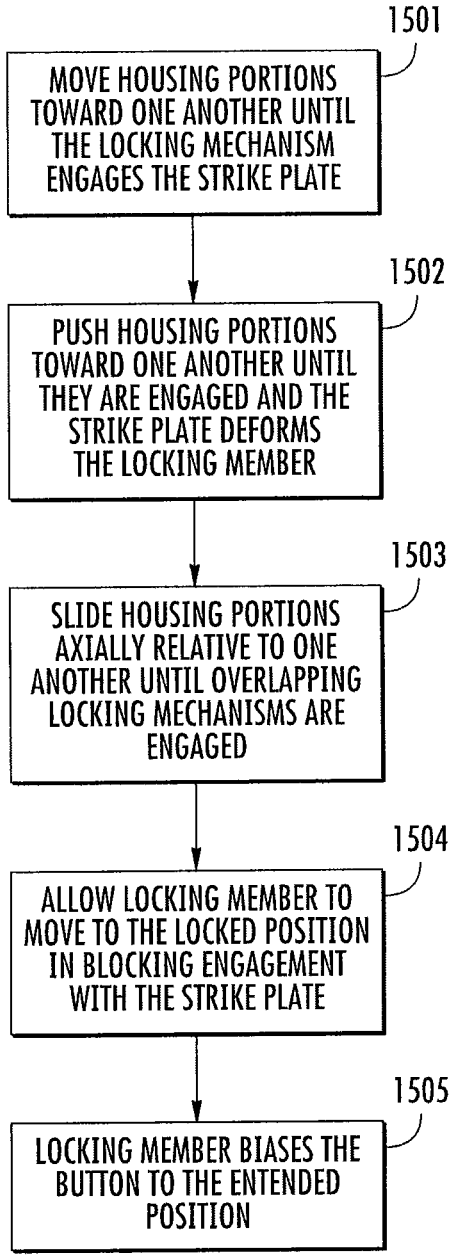

Referring to FIG. 15, the housing 6 may be reassembled by rotating the housing portions 2 and 4 back toward one another until they are in the position shown in FIG. 5 where locking mechanism 48 is engaged by strike plate 50 (block 1501). The housing portions 2 and 4 are pushed toward one another until surface 10 abuts surface 12 and locking member 48 is pushed to the deformed position by strike plate 50 as shown in FIG. 4 (block 1502). Housing portion 2 is slid forward in the axial direction relative to housing portion 4 until the housing portions are coextensive and overlapping locking mechanisms 37 and 39 are engaged as shown in FIGS. 1 and 2 (block 1503). As housing portion 2 moves axially relative to housing portion 4 and approaches the fully closed position, strike plate 50 clears the end 48*b* of locking member 48 allowing locking member 48 to return to the locked position where is positioned behind and in blocking engagement with strike plate 50 (block 1504). When the strike plate 50 clears the end of locking member 48 and locking member 48 returns to its extended position, locking member 48 engages post 62 to bias button 56 to the extended locked position (block 1505).

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A utility knife comprising:

a first housing portion carrying a strike plate;

a second housing portion movable along a first direction relative to the first housing portion between a closed position and an open position, said second housing portion carrying a locking member, an overlapping locking mechanism for locking the first housing portion to said second housing portion when the first housing portion is moved relative to said second housing portion along a second direction;

said locking member movable between a first position in which the locking member engages said strike plate to prevent said first housing from moving relative to said second housing along said first direction and a second position in which the locking member does not engage said strike plate and allows said first housing to move relative to said second housing along said first direction;

a blade carrier that holds a blade in one of an extended and a retracted position relative to said first housing portion and said second housing portion; said blade carrier comprising a latch engageable with a first stop where a position of the first housing portion is fixed relative to the second housing portion when the locking member is in the second position, and the latch engageable with a second stop where movement of the second housing portion relative to said latch in the second direction is enabled when the locking member is in the second position.

2. The utility knife of claim 1 wherein the first housing portion comprises a first perimeter edge that abuts a second coextensive perimeter edge on the second housing portion at a plane, said overlapping locking mechanism extends across said plane.

3. The utility knife of claim 1 wherein said first housing portion carries a pin that extends through a slotted aperture formed in second housing portion such that the first housing portion and second housing portion are rotatable relative to one another about said pin.

4. The utility knife of claim 3 wherein said overlapping locking mechanism is positioned remote from said pin.

5. The utility knife of claim 1 wherein the locking member is biased to the locked position.

6. The utility knife of claim 1 wherein the locking member comprises a resilient member.

7. The utility knife of claim 6 wherein said resilient member comprises of a leaf spring.

8. The utility knife of claim 1 wherein the locking member has a fixed end and a movable end such that when said locking member is in the first position the movable end is positioned directly behind said strike plate.

9. The utility knife of claim 1 further comprising a button that is moveable between a locked position and an unlocked position, said button terminating in a distal end that is disposed opposite the locking member.

10. The utility knife of claim 9 wherein the locking member biases the button to the locked position.

11. The utility knife of claim 9 wherein said button is operable to move said locking member to the second position.

12. The utility knife of claim 1 wherein the locking member biases the first housing portion away from the second housing portion when the second housing portion is in the open position.

13. The utility knife of claim 1 wherein said latch comprises a resilient member comprising a tab.

14. The utility knife of claim 1 wherein an actuator button is connected to said carrier.

15. The utility knife of claim 1 wherein said blade carrier comprises said latch having a first tab and a second tab and said second housing portion comprises a first plurality of recesses that are dimensioned such that the first tab can be located in any one of the first plurality of recesses and said first housing portion comprising a second plurality of recesses that are dimensioned such that the second tab can be located in any one of the second plurality of recesses, at least one of the second plurality of recesses is the second stop and has a width that is longer than a width of the second tab allowing the first housing portion to move rearward relative to the second housing portion.

16. The utility knife of claim 15 wherein a difference between said first width and said second width is sufficient to disengage the overlapping locking mechanism.

17. The utility knife of claim 1 further comprising a blade holder comprising a wireform having a first end secured to one of said first housing portion and said second housing portion, and the wireform having a second free end, said wireform being bent such that the second free end clamps a spare blade against said one of the first housing portion and the second housing portion.

18. A utility knife comprising:

a first housing portion;

a second housing portion movable along a first direction relative to the first housing portion between a closed position and an open position, said second housing portion carrying a locking member, an overlapping locking mechanism for locking the first housing portion to said second housing portion when the first housing portion is moved relative to said second housing portion along a second direction;

said locking member movable between a first position in which the locking member prevents said first housing from moving relative to said second housing along said first direction and a second position in which the locking member allows said first housing to move relative to said second housing along said first direction; and a blade carrier that holds a blade in one of an extended and a retracted position relative to said first housing portion and said second housing portion, said blade carrier comprising a latch engageable with a first stop where a position of the first housing portion is fixed relative to the second housing portion when the locking member is in the second position, and the latch engageable with a second stop where movement of the second housing portion relative to said latch in the second direction is enabled when the locking member is in the second position.

* * * * *